US009205898B2

(12) United States Patent
Schweiger

(10) Patent No.: US 9,205,898 B2
(45) Date of Patent: Dec. 8, 2015

(54) FIN STRUCTURE FOR WATERCRAFT

(71) Applicant: Vlado Schweiger, Postojna (SI)

(72) Inventor: Vlado Schweiger, Postojna (SI)

( * ) Notice: Subject to any disclaimer, the term of this patent is extended or adjusted under 35 U.S.C. 154(b) by 102 days.

(21) Appl. No.: 13/754,265

(22) Filed: Jan. 30, 2013

(65) Prior Publication Data

US 2014/0209006 A1 Jul. 31, 2014

(51) Int. Cl.

| | |
|---|---|
| ***B63B 1/24*** | (2006.01) |
| ***B63B 35/79*** | (2006.01) |
| ***B63B 39/06*** | (2006.01) |

(52) U.S. Cl.

CPC ..... *B63B 39/06* (2013.01); *B63B 35/7923* (2013.01); *B63B 35/7926* (2013.01)

(58) Field of Classification Search

CPC ..... B63B 1/24; B63B 1/248; B63B 1/28; B63B 1/20; B63B 1/242; B63B 39/06; B63B 35/7926; B63B 35/7923

USPC ..... 114/274, 39.15, 39.24, 55, 54, 278, 114/126, 152; 441/74

See application file for complete search history.

(56) References Cited

U.S. PATENT DOCUMENTS

| | | | | |
|---|---|---|---|---|
| 1,410,872 | A * | 3/1922 | Baldwin | 114/20.1 |
| 2,890,672 | A * | 6/1959 | Boericke, Jr. | 114/274 |
| 6,499,419 | B1 * | 12/2002 | Bussard | 114/274 |
| 7,926,437 | B2 * | 4/2011 | Townsend | 114/274 |
| 2005/0287888 | A1 * | 12/2005 | Balester | 441/79 |

FOREIGN PATENT DOCUMENTS

| | | |
|---|---|---|
| FR | 2832692 | 5/2003 |
| WO | WO 9944884 | 9/1999 |
| WO | WO 9965764 | 12/1999 |
| WO | WO 0160690 | 8/2001 |
| WO | WO 2009/100479 | 8/2009 |

OTHER PUBLICATIONS

"Doug Culnane's Blog" http://dougculane.blogspot.com/2014/08/diamond-foil-project.html (dated Aug. 28, 2005, retrieved from the internet by the examiner on Dec. 15, 2014).*

"Design and Build of a Surface Piercing Hydrofoil System", http://www.culane.net/dc/moth/prj/DiamondFoil/index.jsp, Internet Archive Wayback Machine capture of Aug. 25, 2007.*

* cited by examiner

*Primary Examiner* — Anthony Wiest
(74) *Attorney, Agent, or Firm* — Leason Ellis LLP

(57) ABSTRACT

By way of overview and introduction what is disclosed is a fin structure for use with watercraft that is configured to provide lateral stability and generate hydrodynamic lift. The fin structure has a first end that can be connected to the underside of a hull. Two sidewalls extend away from the first end down into the water. As the side walls extend away from the hull, they also first diverge relative to one another and then converge to form a generally diamond shaped fin structure that is symmetric across the longitudinal axis and has an opening in between the sidewalls. Preferably, the sidewalls have a cross-section profile with an outer surface having more curvature than the inner surface. The shape of the fin structure provides lateral stability, hydrodynamic lift and maneuverability.

22 Claims, 8 Drawing Sheets

FIN STRUCTURE FOR WATERCRAFT

TECHNICAL FIELD OF THE INVENTION

This patent application relates generally to the field of watercraft and, in particular, a stabilizing fin for watercraft.

BACKGROUND OF THE INVENTION

Stabilizing fins are primarily used on a watercraft such as sail boats or any similar water going vessels which use a fin or keel and water sports boards such as surfboards, wind-surf boards, kite-surf boards, stand up paddle boards, wake boards and the like. Generally, surf boards, windsurf boards, SUP boards, wake boards and kite surfing boards have a fin or multiple fins attached to their bottoms that enable steering of the board and the ability to counteract the lateral force that tends to move the board in a lateral direction due to the direction of moving of the board on a wave.

In sail boats the main purpose of the keel is to counteract the force of the wind. On sail boats, the wind provides a force which enables the sail boat to move in its desired direction. The force which is caused by the wind is a lateral force which tends to tip the sailing boat.

When it is at rest, a watercraft's weight is borne entirely by the buoyant force of the watercraft. At low speeds generally the watercraft hull (or body, board, etc.) acts as a displacement hull, meaning that the buoyant force is mainly responsible for supporting the watercraft. As speed increases through the water, the shape of the hull causes hydrodynamic lift to increase as well. At some speed, hydrodynamic lift becomes the predominant upward force on the hull and the craft is "planing". Planing decreases drag on the body of the watercraft and allows for increased speed of the watercraft.

Standard fin structures for use in watercraft such as water sports boards generally have one or more single solid fin structures (i.e. not having any openings for the water to flow through) extending from the bottom of the watercraft into the water. Current standard fin structures generally extend along a vertical axis of symmetry and have a symmetrical profile across that axis. Standard fin structures can vary by having different depths, rake angles (extending in the direction of water flow), surface area and cross-section profiles that all depend on the purpose of the board and operating conditions and desired performance characteristics.

In the case of standard fin shapes, when moving through the water, water is flowing in the direction from the leading edge of the fin towards the trailing edge of the fin. In the vicinity of the fin, the water flow deflects and follows the shape of the fin. On each side of the fin, the local water velocity is increased relative to the hull which causes a pressure differential and lateral force is generated and acting on the surface of the fin, perpendicular to the axis of symmetry and direction of water flow. Because the cross section of standard fins have a symmetrical hydrodynamic profile, the lateral force is generated equally on the two opposing sides and act against each-other thereby giving lateral stability to the hull. Because the fin is moving through water, resistance force which occurs acting in the direction the water is flowing, causing what is commonly referred to as fin drag. In addition, because of the symmetric profile of the fin structure, no significant longitudinal force (hydrodynamic lift) is generated to counteract the force of gravity pushing the board into the water therefore does not get the board on plane more easily.

What is desired is a fin structure that provides lateral stability and generates hydrodynamic lift allowing the watercraft to get on plane more easily.

It is with respect to these and other considerations that the disclosure made herein is presented.

SUMMARY OF THE INVENTION

According to a first aspect, a fin structure for use in water is provided. The fin structure includes a body having a first end and opposite second end. The body has a first sidewall and a second sidewall that are at least partially spaced apart from one another so as to form an opening in between the two sidewalls. The sidewalls extend from first end toward the second end, and as the two sidewalls extend, the sidewalls diverge away from each other in the upper region. The two sidewalls then converge in the lower region. In addition, the fin structure can include a bottom portion that connects at least a portion of the first and second sidewalls.

According to another aspect, a fin structure for use in water is provided. The fin structure includes a body having a top end and a bottom end and a pair of sidewalls at least partially spaced apart from one another so as to define a through hole formed between the sidewalls. The through hole has: (1) a height measured along a longitudinal axis of the body that runs the length of the body and (2) a width measured along a horizontal axis that is perpendicular to the longitudinal axis. In addition, the height of the through hole is greater than the width of the through hole at any horizontal axis that is perpendicular to the longitudinal axis.

These and other aspects, features, and advantages can be appreciated from the accompanying description of certain embodiments of the invention and the accompanying drawing figures and claims.

DETAILED DESCRIPTION OF CERTAIN EMBODIMENTS OF THE INVENTION

By way of overview and introduction what is disclosed is a fin structure for use with watercraft that is configured to provide lateral stability and generate hydrodynamic lift to counteract the force of gravity pushing the watercraft and the fin structure into the water and allow the watercraft to plane more easily. In a preferred arrangement the fin structure can be connected to the underside of a hull at a first end. Two sidewalls extend away from the first end down into the water (i.e. along a longitudinal (vertical) axis away from the underside of the hull). As the side walls extend away from the hull, they also first diverge relative to one another and then converge relative to one another to form a generally diamond shaped fin structure that is symmetric across the longitudinal axis and has an opening in between the sidewalls to allow water to flow through. Preferably, the sidewalls have a cross-section profile having outer surface of the sidewalls with more curvature than the inner surface. The symmetric shape of the fin structure provides lateral stability, while the asymmetrical cross-section creates hydrodynamic lift in the longitudinal direction and acting against gravity. In addition, maneuverability is increased.

The referenced systems and methods are now described more fully with reference to the accompanying drawings, in which one or more illustrated embodiments and/or arrangements of the systems and methods are shown. The systems and methods are not limited in any way to the illustrated embodiments and/or arrangements as the illustrated embodiments and/or arrangements described below are merely exemplary of the systems and methods, which can be embodied in various forms, as appreciated by one skilled in the art. Therefore, it is to be understood that any structural and functional details disclosed herein are not to be interpreted as limiting the systems and methods, but rather are provided as a representative embodiment and/or arrangement for teaching one skilled in the art one or more ways to implement the systems and methods.

Figure 1:
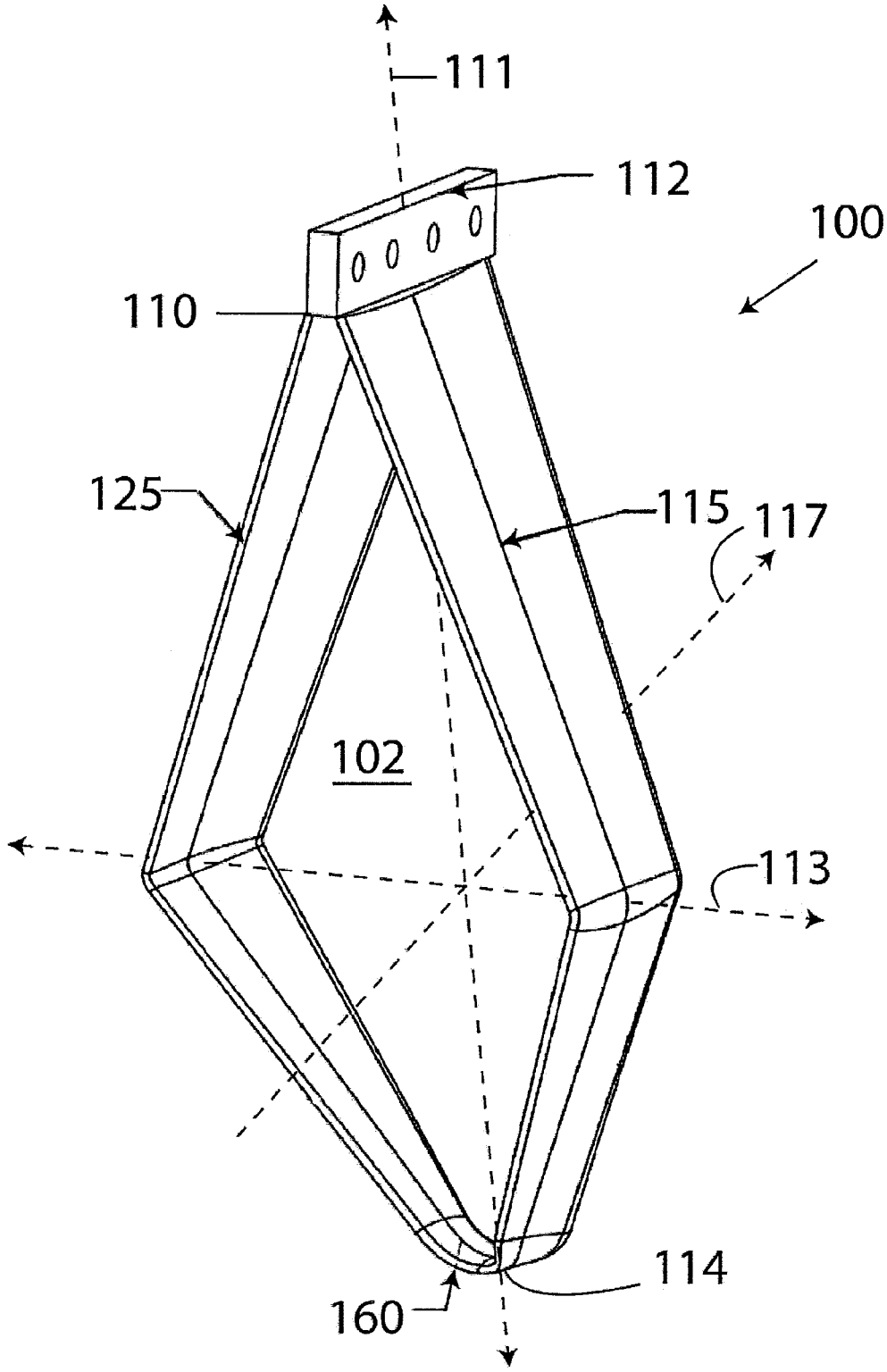
FIG. 1 is a diagram illustrating a perspective view of an exemplary configuration of a fin structure according to an embodiment of the present invention.

FIG. 1 depicts a perspective view of a fin structure 100 according to an exemplary embodiment of the present invention. The fin has a first end 110 and a first sidewall 115 and a second sidewall 125. The first and second sidewalls extend distally from the first end toward a second end 114 opposite the first end along a longitudinal axis 111 which bisects the first end and the second end. As the first and second sidewalls extend distally from the first end, they first diverge relative to one another along a horizontal axis 113 that is perpendicular to the longitudinal axis and also perpendicular to the direction of water flow 117. As first and second sidewalls continue to extend, the first and second sidewalls then converge relative to one another along the horizontal axis to define an opening 102 therebetween. First and second sidewall can be integrally connected at the first end or separate at the first end.

In addition, the fin can include a bottom portion 160 that integrally connects the first and second sidewalls. In this exemplary variation of the disclosed embodiments, the bottom portion integrally connects the distal end of the first and second sidewalls such that the opening is completely bounded by the first and second sidewalls and the bottom portion. Alternatively, the bottom portion can integrally connect the first and second sidewalls at any location of the first and second sidewalls to define an opening that is bounded by a portion of the first and second sidewalls and the bottom portion. The bottom portion can be an arcuate shaped wall, however the bottom portion can take alternative shapes as would be understood by those skilled in the art. Moreover, preferably the bottom portion is bisected by the longitudinal axis 111.

Preferably, the fin structure is symmetric across the longitudinal axis and as such the first sidewall 115 and the second sidewall 125 mirror one another (have identical yet reversed shapes).

Figure 2A:
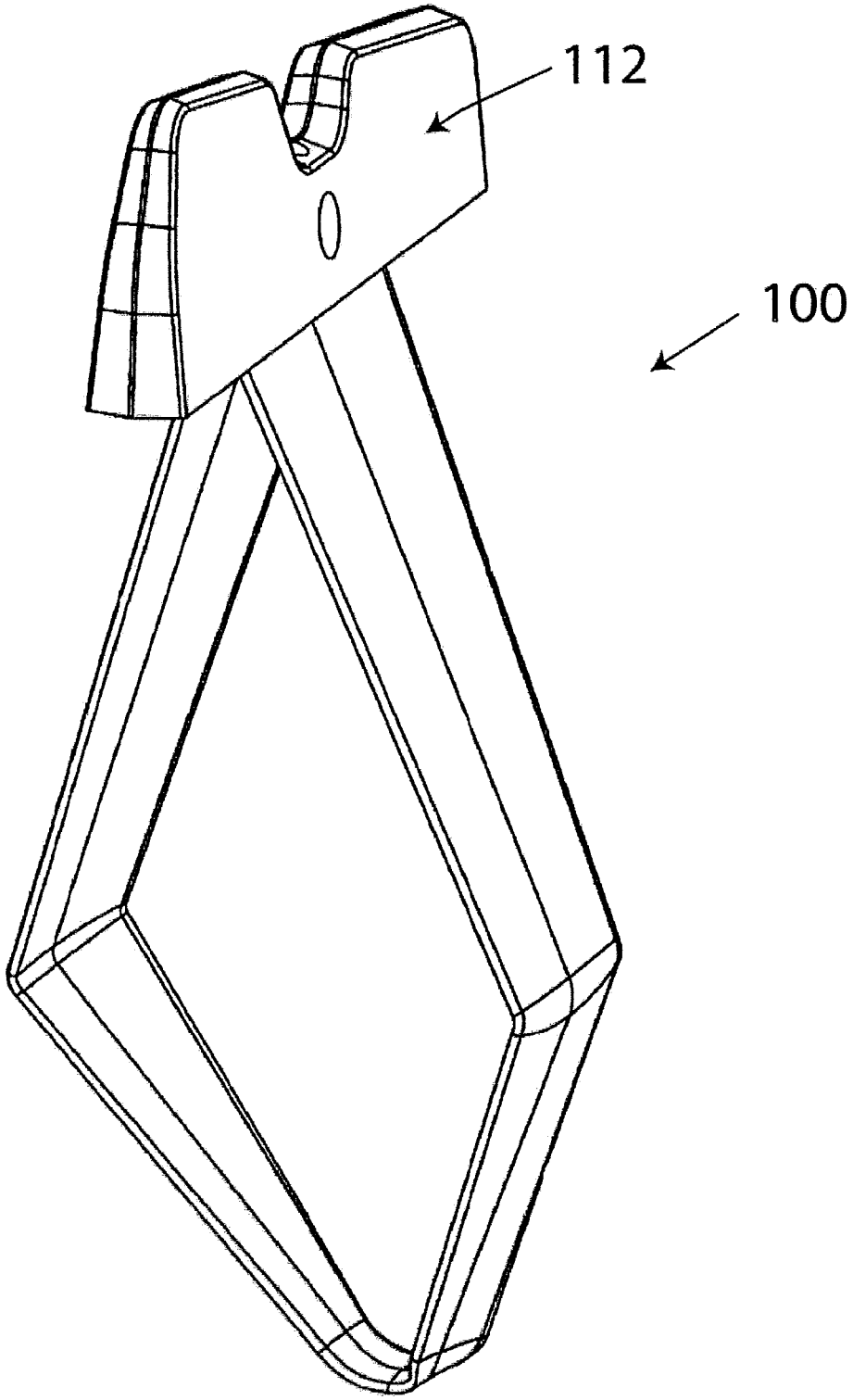
FIG. 2A is a diagram illustrating a perspective view of an exemplary configuration of a fin structure according to an embodiment of the present invention.

Fin 100 can also include one or more mounts 112 located at the first end. Mount 112 has the primary purpose of connecting the fin structure to a vessel as would be understood by those skilled in the art. FIG. 2A depicts an alternate configuration of mount 112. It should be understood that the particular size and shape of the top end 110 (as depicted in FIG. 1) and/or mount 112 can vary depending on the particular configuration of the fin (i.e., the shape of the fin as dictated by desired performance characteristics) and/or the application of the fin (i.e., the type of vessel the fin is attached to). Returning to FIG. 1, as mentioned above, first and second sidewall can be integrally connected at the first end or alternatively separate at the first end. Moreover, first and second sidewall can be integrally connected to mount 112 or shaped to define mount as would be understood by those skilled in the art.

Figure 2B:
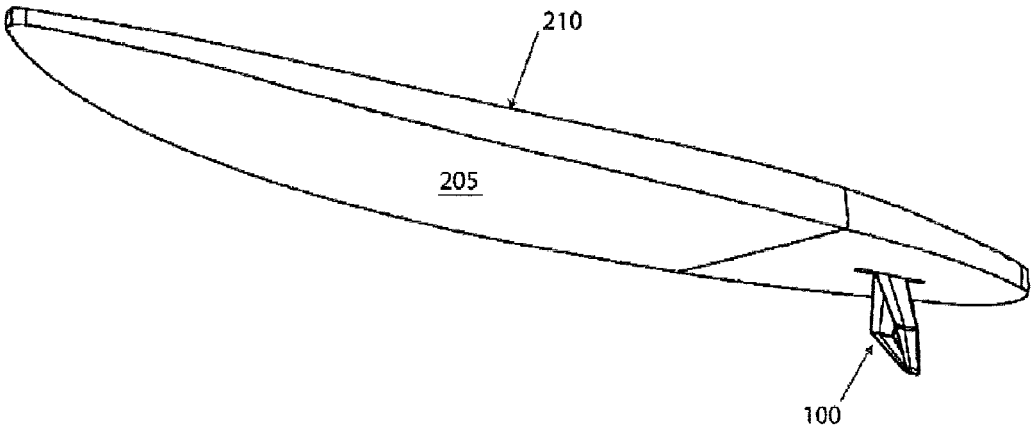
FIG. 2B is a simplified diagram illustrating a perspective view of an exemplary configuration of a watercraft and fin structure according to an embodiment of the present invention.

Turning briefly to FIG. 2B, a watercraft 210 is depicted which in this exemplary embodiment is a surfboard. The fin 100 is attached to the underside 205 of the surfboard. In practice, the surfboard is placed onto the water surface with the underside down such that the fin is at least partially submerged in the water. When the fin is mounted to the vessel at least a portion of the mount (not shown) can be not visible.

Figure 3:
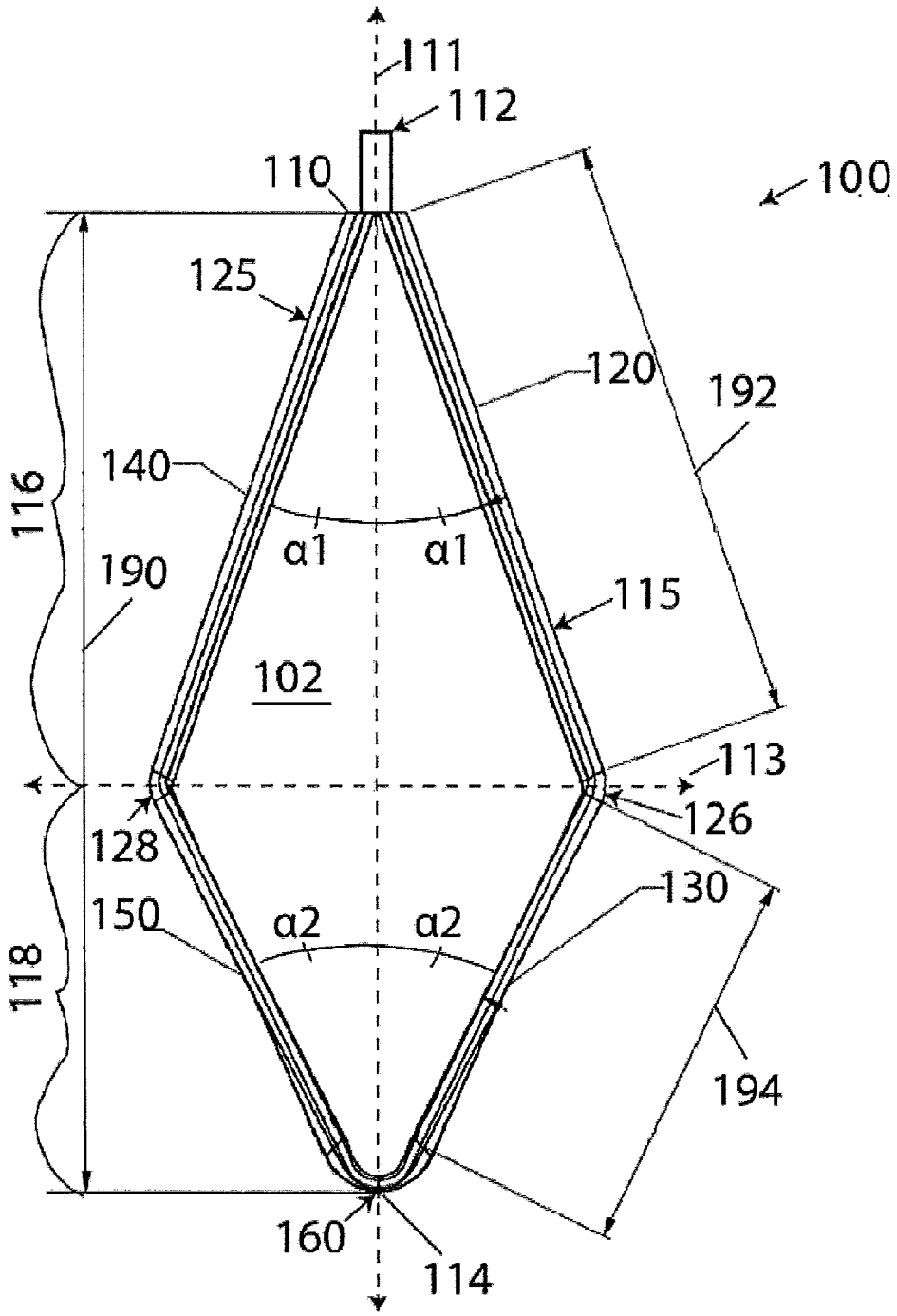
FIG. 3 is a diagram illustrating a front view of an exemplary configuration of a fin structure according to an embodiment of the present invention.

In reference to FIG. 3 which depicts a front plan view of fin structure 100 according to an exemplary embodiment of the present invention, first sidewall 115 can include a first upper sidewall 120 and first lower sidewall 130. Similarly, second sidewall 125 can include a second upper sidewall 140 and second lower sidewall 150. At least first upper sidewall and second upper sidewall define an upper region 116 of the fin. Similarly, at least first lower sidewall and second lower sidewall define a lower region 118 of the fin 100. First upper sidewall and first lower sidewall can define a first transition 126 at the intersection of the upper and lower regions. Similarly, second upper sidewall and second lower sidewall can define a second transition 128 at the intersection of the upper and lower regions. Preferably, the first and second intersections have an arcuate shape. The radius of curvature of the first and second transition can be varied and it should be understood that the first and second transitions can have other possible shapes, including but not limited to a single defined angle, or multi angle transition as would be understood by those skilled in the art.

Preferably, mount, first and second sidewalls and bottom portion are made from the same material, however a combination of materials can be used. In addition, the fin structure can be made from multiple pieces. One or more pieces of the fin structure can also be made by multiple pieces joined together by heat welding, glue or other adhesive, fasteners, joints or other suitable temporary or permanent joining means. Alternatively, one or more pieces of the fin structure can be formed as a single structure. Preferably, the fin structure is made of a light sturdy plastic, such as acrylonitrile-butadiene-styrene copolymer, polyethylene, polyvinyl chloride, polycarbonate, polyproplene or styrene and the like. It may, however, be made from any strong, sturdy and water resistant material, such as metals, composites, fiberglass and the like as would be understood by those skilled in the art.

In this exemplary embodiment, fin 100 has a generally diamond shape with a generally diamond shaped opening 102. More specifically, first upper sidewall 120 and second upper sidewall 140 each generally extend from the first end 110 along the longitudinal axis 111 and the horizontal axis 113 at the angle $\alpha 1$ relative to the longitudinal axis 111. Preferably angle $\alpha 1$ is within the range of 0 to 75 degrees, and can be varied according to the desired hydrodynamic characteristics of the fin. Preferably, and without limitation, the first and second upper sidewalls have an identical length 192 which is greater than 0 and less than the depth 190 of the fin 100. First lower sidewall 130 and second lower sidewall 150 extend from the distal end of the first upper sidewall 120 and second upper sidewall 140, respectively at an angle $\alpha 2$ relative to the longitudinal axis. Preferably, the length 194 of the first and second lower sidewalls is identical and is a function of the fin depth 190, length 192 and angles $\alpha 1$ and $\alpha 2$. In addition length 194 can also be a function of the dimensions of the bottom portion 160.

Figure 4A:
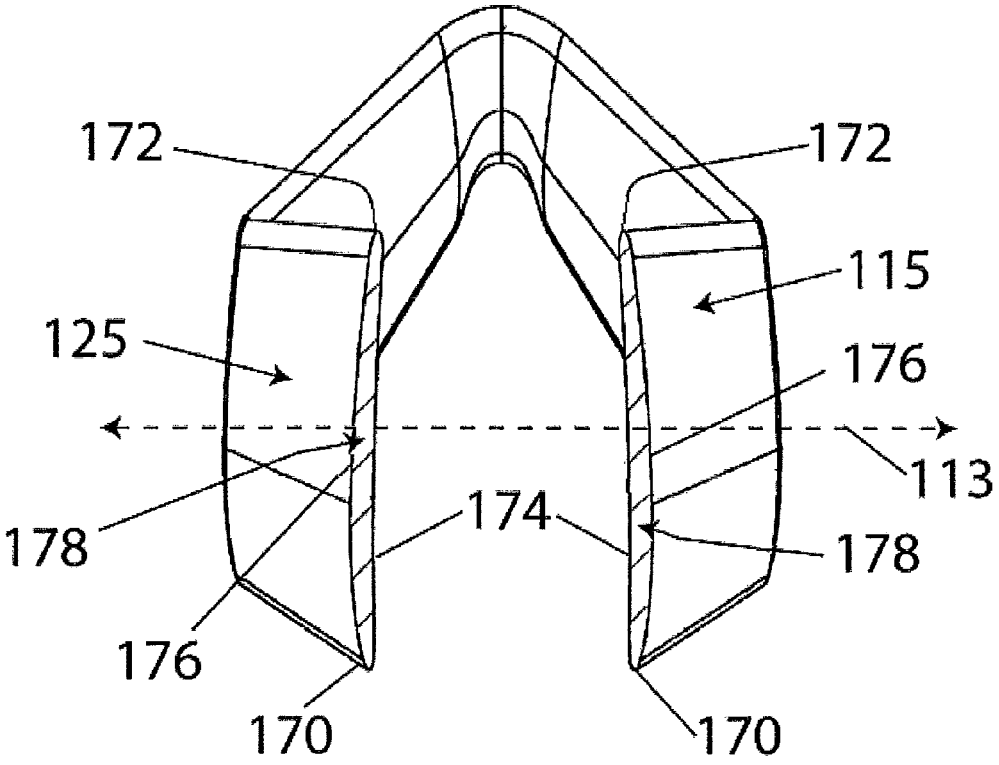
FIG. 4A is a diagram illustrating a cross-sectional view of an exemplary configuration of a fin structure according to an embodiment of the present invention.
Figure 4B:
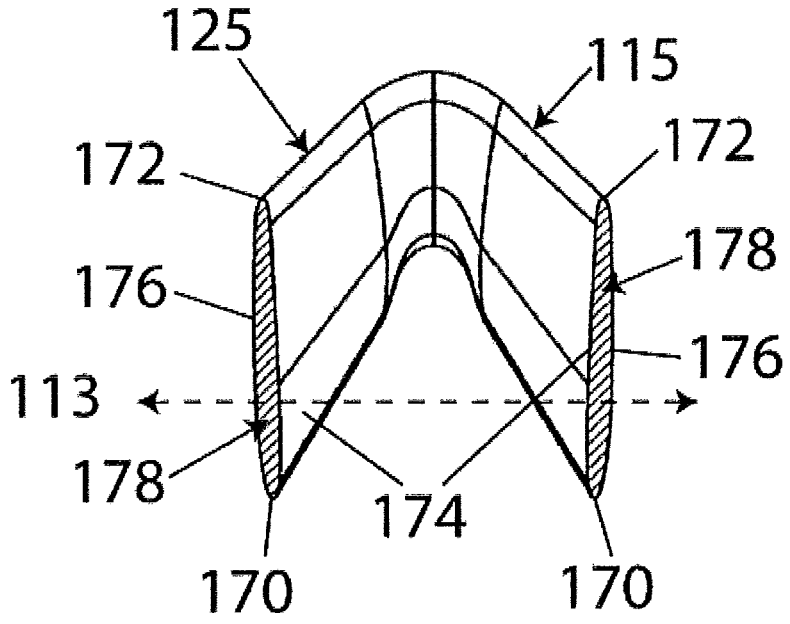
FIG. 4B is a diagram illustrating a cross-sectional view of an exemplary configuration of a fin structure according to an embodiment of the present invention.

Turning now to FIG. 4A, which depicts an exemplary cross-section of the first sidewall 115 and second sidewall 125 taken in a transverse direction in the upper region of the fin 100. Each of the first and second sidewalls include a leading edge 170, a trailing edge 172, an inner surface 174 and an outer surface 176, which define the cross-section 178 of each the first and second sidewalls in the upper region of the fin 100. Turning briefly to FIG. 4B, which depicts an exemplary cross sectional view of the first sidewall 115 and second sidewall 125 in the lower region. Each of the first and second sidewall include a leading edge 170, a trailing edge 172, an inner surface 174 and an outer surface 176, which defines the cross-section 178 of the first and second sidewalls in the lower region (not pictured). It should be understood that, preferably, the cross-section of first and second sidewalls, when taken in the transverse direction at the same point along the longitudinal axis, mirror one another (have identical yet reversed shapes). It should also be understood that the leading edge 170, trailing edge 172, inner surface 174 and outer surface 176 can continue through the transitions between the upper region, lower region and bottom portion 160 of fin 100 and as such, all constituent elements in the upper and lower regions of the fin structure have a cross-section 178.

Referring now to FIGS. 4A and 4B, preferably, cross-section 178 when taken in a transverse direction at any point on the longitudinal axis has an asymmetric shape. The particular asymmetric cross-section shape can be varied according to the desired performance characteristics of the fin 100. The particular shape of the cross-section of the first and second sidewalls taken in a transverse direction can vary from one point along the longitudinal axis to another as a function of the distance between the leading edge 170 and trailing edge 172, as well as the particular shape of the outer surface 176 or inner surface 178 at that particular point. Furthermore, it is preferable that in at least the upper region, the radius of curvature of the outer surface is greater than the radius of curvature of the inner surface.

The particular shape of the cross-section 178 for the various portions of the first and second sidewall, transitions and bottom portion 160 of the fin vary depending on the desired performance characteristics of the fin 100. The main purpose of the fin is to provide stability of the board and better guidance during maneuvers and tricks on the water. More specifically, the performance of the fin generally depends of fin depth (i.e., length 190), fin rake angle, cross-section 178 and the surface area of the fin. The variations of cross-section shapes, including sidewall curvatures that can affect hydrodynamic lift, maneuverability and other performance characteristics would be understood by those skilled in the art. For example, in the upper region, the outer surface can have a greater curvature than the inner surface to provide hydrodynamic lift; in addition, for at least a portion of the lower region, the radius of curvature of the outer surface can be greater than the inner surface to provide some downward hydrodynamic force, in addition, the radius of curvature of the remaining pieces of the lower region including the bottom portion 160 can have an inner surface with a greater radius of curvature than the outer surface to provide hydrodynamic lift, generating a net lifting effect by the fin.

Although the disclosed embodiments of the present invention describe a fin 100 that is symmetric across the longitudinal axis it should be understood that, depending on the desired performance characteristics, the fin can be asymmetrical and first and second sidewalls and/or bottom portion can have non-mirrored cross-sections when taken in the transverse direction at the same point along the longitudinal axis. For example, non-symmetric fin shape may be desirable if, say, the fin needs to pull in a particular horizontal direction more.

Figure 5:
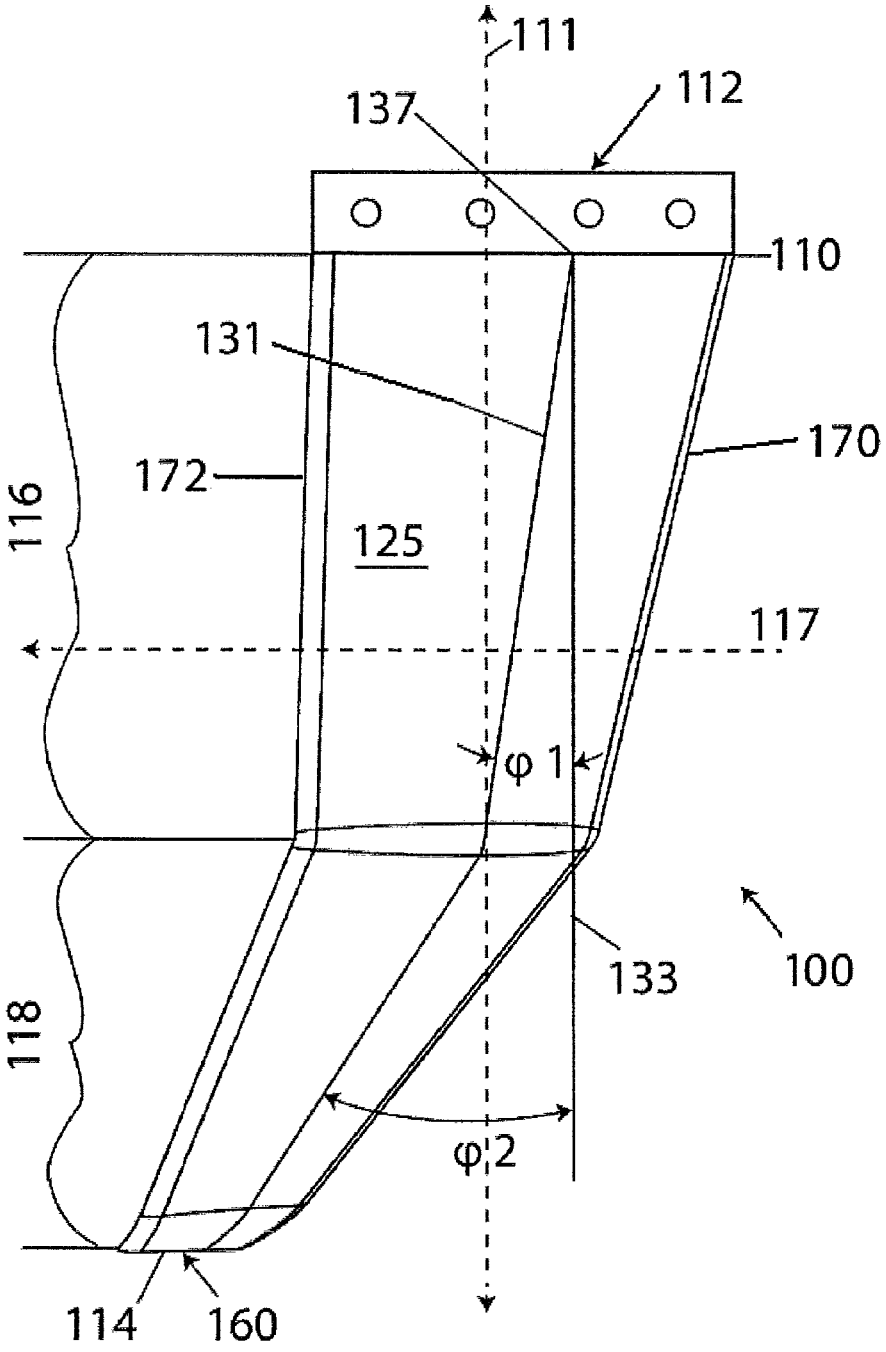
FIG. 5 is a diagram illustrating a side plan view of an exemplary configuration of a fin structure according to an embodiment of the present invention.

In reference to FIG. 5, which is a side plan view of fin 100, second sidewall 125 and first sidewall (not pictured because hidden behind second sidewall) can extend in the direction of the water flow 117 at one or more rake angles. As discussed above, the direction of water flow is perpendicular to both the longitudinal axis 111 and horizontal axis (not pictured). In this exemplary embodiment, first and second sidewalls extend in the direction of water flow at a first rake angle $\phi 1$ in the upper region 116. In addition, the first and second sidewalls extend in the direction of water flow at a second rake angle $\phi 2$ in the lower region 116. Rake angle is measured between (a) the rake line 131 defined by the outermost portion of the outer surface relative to the longitudinal axis and a reference line 133 which is drawn parallel to the longitudinal axis from the point where the rake line begins at the first end 110. Preferably, first rake angle and second rake angle can range in value between 0 and 75. It should be understood that although this exemplary embodiment is described as having two rake angles, the fin can have any number of rake angles. In addition or alternatively the first and second sidewalls can also have continuously varying rake angle such as a curved shape as would be understood by those skilled in the art. In addition, as depicted in FIG. 5, the distance between the leading edge 170 and trailing edge 172 of the sidewalls can be varied to adjust performance characteristics of the fin.

Figure 6:
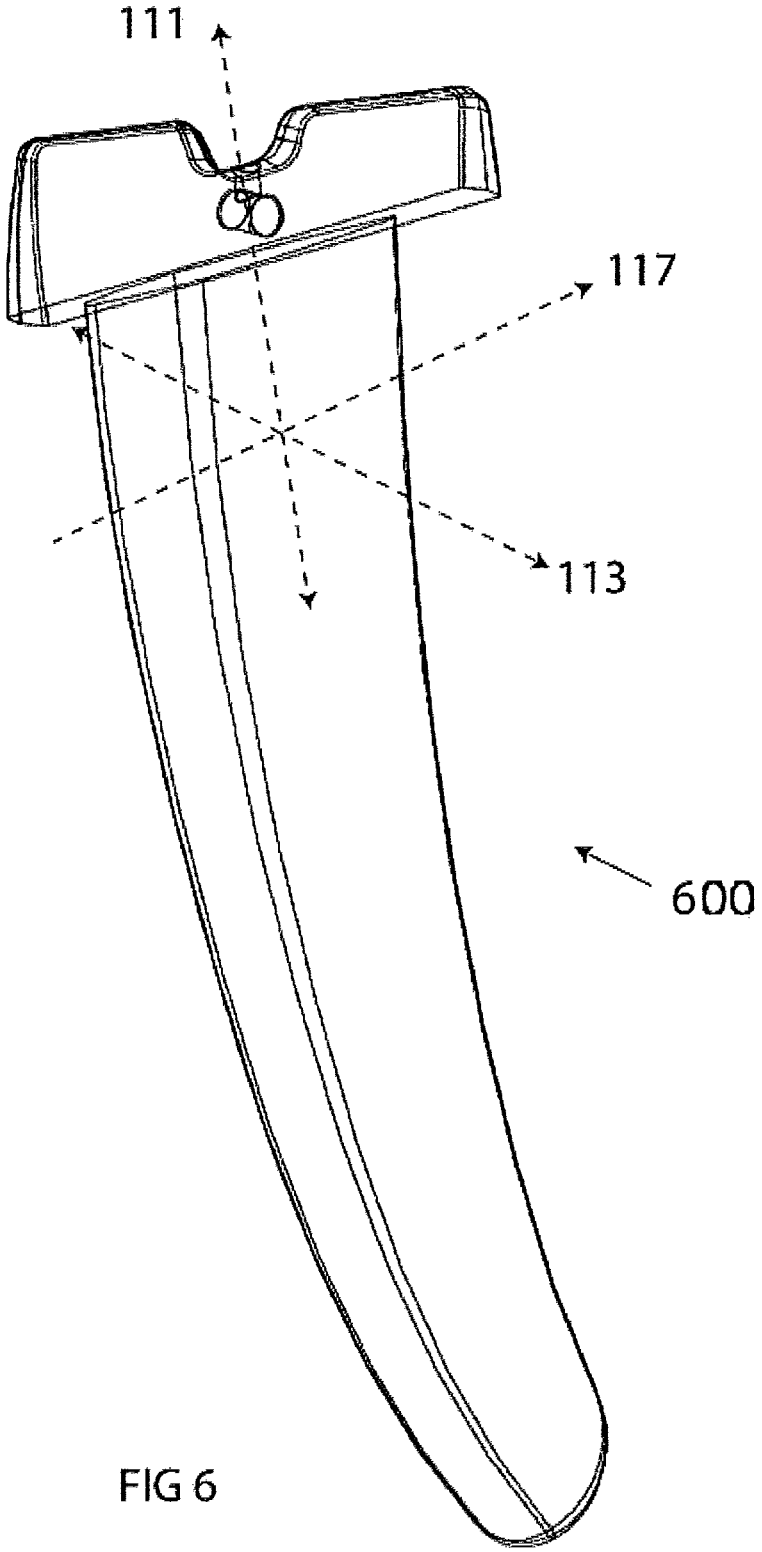
FIG. 6 is a diagram illustrating a perspective view of a standard fin structure.

In practice, the direction of water flow 117 is from the leading edge 170 of the fin 100 towards the trailing edge 172. In the vicinity of the fin the water flow deflects around the fin and follows the shape of the fin. Because the cross-section of the fin is a hydrodynamic profile the disclosed embodiment generates beneficial performance characteristics In a standard shaped fin 600, as depicted in FIG. 6, symmetrical profiles are generally used. As the water moves past the fin 600 in the water flow direction 117, the local velocity is increased across the surface of the fin relative to the fin itself which causes a pressure differential and lateral force is a generated on sides, opposing each other, acting in the horizontal direction 113 which gives stability to a board. Because the fin is moving through water also a resistance force occurs acting in the direction of water flow 117 (i.e. fin drag).

In the practical application of a standard shaped fin 600 on, say, a surfboard, the board itself must be buoyant to counteract gravity and keep the board and a surfer standing on the board afloat. The board itself is buoyant and floats on the water with the surfer on it the weight is increased and extra lift is needed to stay on the surface. When the board is moving the board shape generates hydrodynamic lift force in the longitudinal direction which supplements buoyancy and keeps the board and surfer on the surface. The greater the speed of the board, the greater the hydrodynamic lift is generated. As explained, standard fins moving through the water provide extremely small hydrodynamic lift or in most cases no hydrodynamic lift at all to counteract gravity.

In practical application of the fin structure 100 as described in relation to FIGS. 1-5, because of its asymmetric cross-section 178, provides hydrodynamic lift in the longitudinal direction 111 with increasing speed of the board, while because of the symmetric shape of the fin 100 provides lateral stability in the horizontal direction 113. Moreover, the symmetric shape and opening 102 and cross-section shape results in relatively less drag force acting in the direction of water flow 117.

For example, provided two equal boards, the first having a standard fin shape and the second having a fin 100 according to the disclosed embodiments, the second board will plane sooner. Moreover, the second board should have relatively better control and maneuverability on turns. More specifically, with a standard fin on a turn, the board is deflected and also is the fin (i.e., the board and fin are rotated about the direction of water flow 117). Because of the rotation, the surface area which provides lateral force in the horizontal direction 113, is reduced. The greater the deflection of the board and the fin, the greater the reduction of the surface area providing lateral force and consequently a decrease in lateral force which provides stability. However, when a turn is made using fin 100, significant lateral force is maintained because the generally diamond shape maintains significant surface area that is laterally inclined (i.e., oriented generally along the longitudinal axis 111) and providing lateral force. When upright (i.e., inclined in the longitudinal axis), the upper first sidewall 120, lower first sidewall 130 oppose the upper second sidewall 140 and lower second sidewall 150. In a turn, where the axis of rotation is the water flow direction 117 and we rotate the fin in a counterclockwise direction, than the upper second sidewall 140 and lower first sidewall 130 move toward alignment in the longitudinal axis 111. Accordingly, upper second sidewall 140 and lower first sidewall 130 oppose one another and provide a full surface on which lateral force in horizontal direction 113 is generated. In addition, the use of asymmetric profile adds to better maneuverability. Varying the length and cross-section of upper first sidewall 120, lower first sidewall 130, lower second sidewall 150, upper second sidewall 140 as well as angles $\alpha 1$, $\alpha 2$, rake angles and other physical attributes of fin 100 can adjust the performance characteristics of fin 100 including the amount of hydrodynamic lift, stability, drag and maneuverability as would be understood by those skilled in the art.

Thus, while there have been shown, described, and pointed out fundamental novel features of the invention as applied to several embodiments, it will be understood that various omissions, substitutions, and changes in the form and details of the devices illustrated, and in their operation, may be made by those skilled in the art without departing from the spirit and scope of the invention. Substitutions of elements from one described embodiment to another are also fully intended and contemplated. It is also to be understood that the drawings are not necessarily drawn to scale, but that they are merely conceptual in nature. The invention is defined solely with regard to the claims appended hereto, and equivalents of the recitations therein.

What is claimed:

1. A fin structure for use attached to a water sports board, comprising:

a body having a first end and opposite second end, the body being defined by a first sidewall and a second sidewall that are at least partially spaced apart from one another so as to define a single generally kite-shaped opening therebetween, wherein the first and second sidewalls extend distally from the first end toward the second end to define an upper region and a lower region, wherein in a direction from the first end towards the second end, the first and second sidewalls initially diverge relative to one another to define equal length first segments so as to comprise the upper region and then converge relative to one another to define equal length second segments so as to comprise the lower region wherein the first segments have a length that is greater than the second segments such that the upper region is taller than the lower region, and the body further comprising a bottom portion comprising an arcuate shaped wall and integrally connecting the first and second sidewalls at the second end, wherein the first and second sidewalls intersect at the first end and are symmetric relative to a longitudinal axis that bisects the first end and the bottom portion, wherein each of the first and second sidewalls have an inner surface and an outer surface opposite to the inner surface defining a cross-section, wherein the outer surface has a greater radius of curvature than the inner surface in the upper region and wherein the outer surface of the sidewalls in at least a portion of the lower region has a greater radius of curvature than the inner surface, wherein the body has a maximum height that is greater than a maximum width of the body; and a mount disposed at the first end of the body, wherein the mount is configured to attach the kite-shaped body to a bottom surface of the water sports board.

2. The fin structure of claim 1, wherein the opening is continuously bounded by the first and second sidewalls and the bottom portion.

3. The fin structure of claim 1, wherein the longitudinal axis bisects the intersection of the first and second sidewall at the first end and bisects the arcuate bottom portion integrally connecting the first and second sidewall at the second end.

4. The fin structure of claim 1, wherein the mount is configured to mount the body to a bottom surface of the water sports board such that the body extends from the bottom surface.

5. The fin structure of claim 4, wherein the mount is disposed above an intersection of the first and second sidewalls and is configured to mount the body to the bottom surface of the watersports board such that the kite-shaped body is adjacent to the bottom surface of the board.

6. The fin structure of claim 4, wherein the first and second sidewalls are integrally connected to the mount.

7. The fin structure of claim 1, wherein the first and second sidewalls diverge at a first angle in the upper region.

8. The fin structure of claim 7, wherein the first angle is between 0 and 75 degrees relative to a longitudinal axis, wherein the longitudinal axis bisects the first end and the second end.

9. The fin structure of claim 1, wherein the first and second sidewalls converge at a second angle in the lower region.

10. The fin structure of claim 9, wherein the second angle is between 0 and 90 degrees relative to a longitudinal axis, wherein the longitudinal axis bisects the first end and the second end.

11. The fin structure of claim 1, the first and second sidewalls each having a transition at the intersection of the upper and lower regions.

12. The fin structure of claim 11, wherein the transition is arcuate.

13. The fin structure of claim 1, wherein the bottom portion integrally connects a distal end of each of the first and second sidewalls.

14. The fin structure of claim 1, wherein the opening is formed completely and continuously from the first end to the bottom section.

15. The fin structure of claim 1, wherein each of the first and second sidewalls have a leading edge, a trailing edge opposite to the leading edge, an inner surface and an outer surface opposite to the inner surface defining a cross-section.

16. The fin structure of claim 1, wherein the bottom portion has a leading edge, a trailing edge opposite to the leading edge, an inner surface and an outer surface opposite to the inner surface.

17. The fin structure of claim 16, wherein a cross-section, taken in a transverse direction, of each of the first and second sidewalls is asymmetric.

18. The fin structure of claim 16, wherein the first and second sidewalls extends in the direction of the trailing edge of the first and second sidewalls at a first rake angle at the upper region.

19. The fin structure of claim 16, wherein the first and second sidewalls extend in the direction of the trailing edge of the first and second sidewalls at a second rake angle at the lower region.

20. The fin structure of claim 1, wherein the body in the upper region is substantially taller than the body in the lower region.

21. A fin structure for use with a water sports board, comprising:

a body having a top end and a bottom end and a pair of sidewalls at least partially spaced apart from one another so as to define a single continuously bounded generally kite-shaped opening therebetween, the opening having: (1) a height measured along a longitudinal axis of the body that runs a length of the body and that bisects the top end and the bottom end and (2) a width measured along a transverse axis that extends though the first and second spaced sidewalls and is perpendicular to the longitudinal axis, wherein the height is greater than the width of the opening at any transverse axis, the body further comprising an arcuate shaped wall at the bottom end integrally connecting the pair of sidewalls, wherein the sidewalls intersect at the top end and are symmetric relative to the longitudinal axis and wherein the sidewalls diverge at a first angle in the upper region and converge at a second angle in the lower region, whereby the body and the opening defined by the so configured sidewalls and bottom portion are kite-shaped and wherein the body in the upper region is taller than the body in the lower region;

wherein the sidewalls each have an inner surface and an outer surface opposite to the inner surface defining a respective cross-section, wherein the outer surface of the sidewalls have a greater radius of curvature than the inner surface in the upper region and wherein the outer surface of the sidewalls in at least a first portion of the lower region has a greater radius of curvature than the inner surface; and a mount disposed at the top end of the body, wherein the mount is configured to attach the body to a bottom surface of a water sports board such that the body extends from the bottom surface.

22. The fin structure of claim 21, wherein the outer surface of the sidewalls in at least a second portion of the lower region have a smaller radius of curvature than the inner surface.

* * * * *